US007699175B2

(12) United States Patent
Lobiondo

(10) Patent No.: US 7,699,175 B2
(45) Date of Patent: Apr. 20, 2010

(54) PUZZLE STORAGE AND TRANSPORTATION SYSTEM

(75) Inventor: Jon Lobiondo, Milton, DE (US)

(73) Assignee: Lobo Enterprises, LLC, Milton, DE (US)

( * ) Notice: Subject to any disclaimer, the term of this patent is extended or adjusted under 35 U.S.C. 154(b) by 246 days.

(21) Appl. No.: 11/774,391

(22) Filed: Jul. 6, 2007

(65) Prior Publication Data

US 2009/0008278 A1 Jan. 8, 2009

(51) Int. Cl.
*B65D 69/00* (2006.01)
*A63F 9/08* (2006.01)

(52) U.S. Cl. ..... 206/579; 206/315.1; 273/157 R

(58) Field of Classification Search ..... 206/38, 206/216, 223, 315.1, 577, 579, 37, 575; 220/524; 273/153 R, 156, 157 R; 383/38–40; 53/443
See application file for complete search history.

(56) References Cited

U.S. PATENT DOCUMENTS

| | | | | |
|---|---|---|---|---|
| 3,802,613 | A | 4/1974 | Droeger | |
| 3,948,528 | A | 4/1976 | Goodman, Jr. et al. | |
| 3,963,102 | A | 6/1976 | Carp | |
| 3,994,372 | A | 11/1976 | Geller et al. | |
| 4,088,252 | A | 5/1978 | Grunberger | |
| 4,099,656 | A | 7/1978 | Neumann et al. | |
| 4,261,448 | A | 4/1981 | Myers et al. | |
| 4,302,013 | A * | 11/1981 | Kavis | 273/157 R |
| 4,479,651 | A * | 10/1984 | LaFleur | 273/157 R |
| 4,552,361 | A * | 11/1985 | LaFleur | 273/157 R |
| 4,974,709 | A | 12/1990 | Furlow et al. | |
| 5,090,526 | A | 2/1992 | Jacober | |
| 5,345,633 | A | 9/1994 | Harnish | |
| 5,370,460 | A | 12/1994 | Nelson | |
| 5,447,227 | A * | 9/1995 | Kosberg | 206/38 |
| 5,595,302 | A | 1/1997 | Maydwell et al. | |
| 5,624,118 | A * | 4/1997 | Gottesman | 273/157 R |
| 5,706,992 | A | 1/1998 | Moor | |
| 5,881,850 | A | 3/1999 | Murdoch | |
| 5,897,209 | A | 4/1999 | Roegner | |
| 5,904,230 | A | 5/1999 | Peterson | |
| 6,126,012 | A | 10/2000 | Roegner | |
| 6,179,102 | B1 | 1/2001 | Weber et al. | |
| 6,183,133 | B1 | 2/2001 | Roegner | |
| 6,230,950 | B1 | 5/2001 | Heetman | |
| 6,394,157 | B2 * | 5/2002 | Luna | 383/38 |
| 6,663,459 | B2 | 12/2003 | Ostolaza | |
| 6,767,014 | B2 | 7/2004 | Dolin | |
| 6,769,588 | B2 | 8/2004 | Zheng | |
| 2006/0102667 | A1 * | 5/2006 | Padilla | 224/153 |

* cited by examiner

*Primary Examiner*—Luan K Bui
(74) *Attorney, Agent, or Firm*—Hunton & Williams, LLP; Daniel G. Vivarelli, Jr.

(57) ABSTRACT

A puzzle storage and transport system including a puzzle including one or more puzzle pieces and a puzzle board and a container to store and transport one or more puzzle pieces. The container includes a pouch defining a cavity to contain the one or more puzzle pieces and including a closure to provide access to the cavity and one or more straps coupled to the pouch to bind the container to the puzzle board.

10 Claims, 13 Drawing Sheets

PUZZLE STORAGE AND TRANSPORTATION SYSTEM

FIELD OF THE DISCLOSURE

Exemplary embodiments of the disclosure are related generally to a puzzle transportation system and more particularly to a container for transporting puzzle pieces and corresponding puzzle boards.

BACKGROUND OF THE DISCLOSURE

Children who play with puzzles tend to lose the pieces of the puzzle. This problem can occur more often when children and/or parents transport the puzzles to various locations. Puzzle covers do not provide an effective way to transport or store puzzles because they cover up the puzzle, making it difficult to view the picture associated with the puzzle. Moreover, where a puzzle cover is elastically coupled to a puzzle board, the pieces are likely to fall out when the cover is removed.

These and other drawbacks exist.

SUMMARY

Exemplary embodiments of the invention may provide a puzzle storage and transport system including a puzzle including one or more puzzle pieces and a puzzle board and a container to store and transport one or more puzzle pieces. The container includes a pouch defining a cavity to contain the one or more puzzle pieces and including a closure to provide access to the cavity and one or more straps coupled to the pouch to bind the container to the puzzle board.

Exemplary embodiments of the invention also provide a method for storing and transporting one or more puzzle pieces. The method may include containing the one or more puzzle pieces within a container, and binding the container to the puzzle board. The container may include a pouch defining a cavity to contain the one or more puzzle pieces and including a closure to provide access to the cavity, and one or more straps coupled to the pouch to bind the container to a puzzle board;

DETAILED DESCRIPTION

Exemplary embodiments are discussed in detail below. While specific exemplary embodiments are discussed, it should be understood that this is done for illustration purposes only. A person skilled in the relevant art will recognize that other components and configurations can be used without departing from the spirit and scope of the claimed inventions.

Various exemplary embodiments provide for a system to store and/or transport pieces of a puzzle. A puzzle may include any set of varied, irregularly shaped pieces that, when properly assembled, may form a picture, map, or the like. For example, a puzzle may include a children's puzzle having a puzzle board with cutouts of different shapes. Pieces of the children's puzzle may have shapes corresponding to the cutouts such that the pieces may be placed into the cut outs to complete the puzzle. The pieces may be flat, raised, and/or have wooden or plastic pegs extending from a top surface of the piece to enable grasping of the piece.

Puzzles may be wooden with wooden pieces. Puzzles may also have magnetic boards with magnetic pieces or felt boards with felt pieces. Puzzles may have thick cardboard boards with cardboard pieces. Puzzle boards may have a rectangular, square, triangular, circular, oval, or other shape.

Figure 1B:
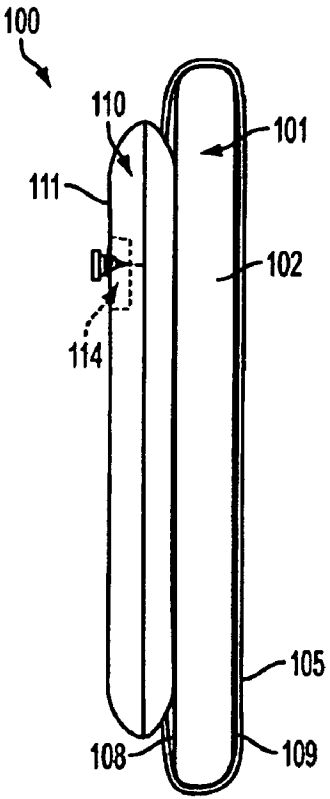
FIG. 1B depicts an exemplary puzzle storage and transportation system according to an embodiment of the disclosure.
Figure 1A:
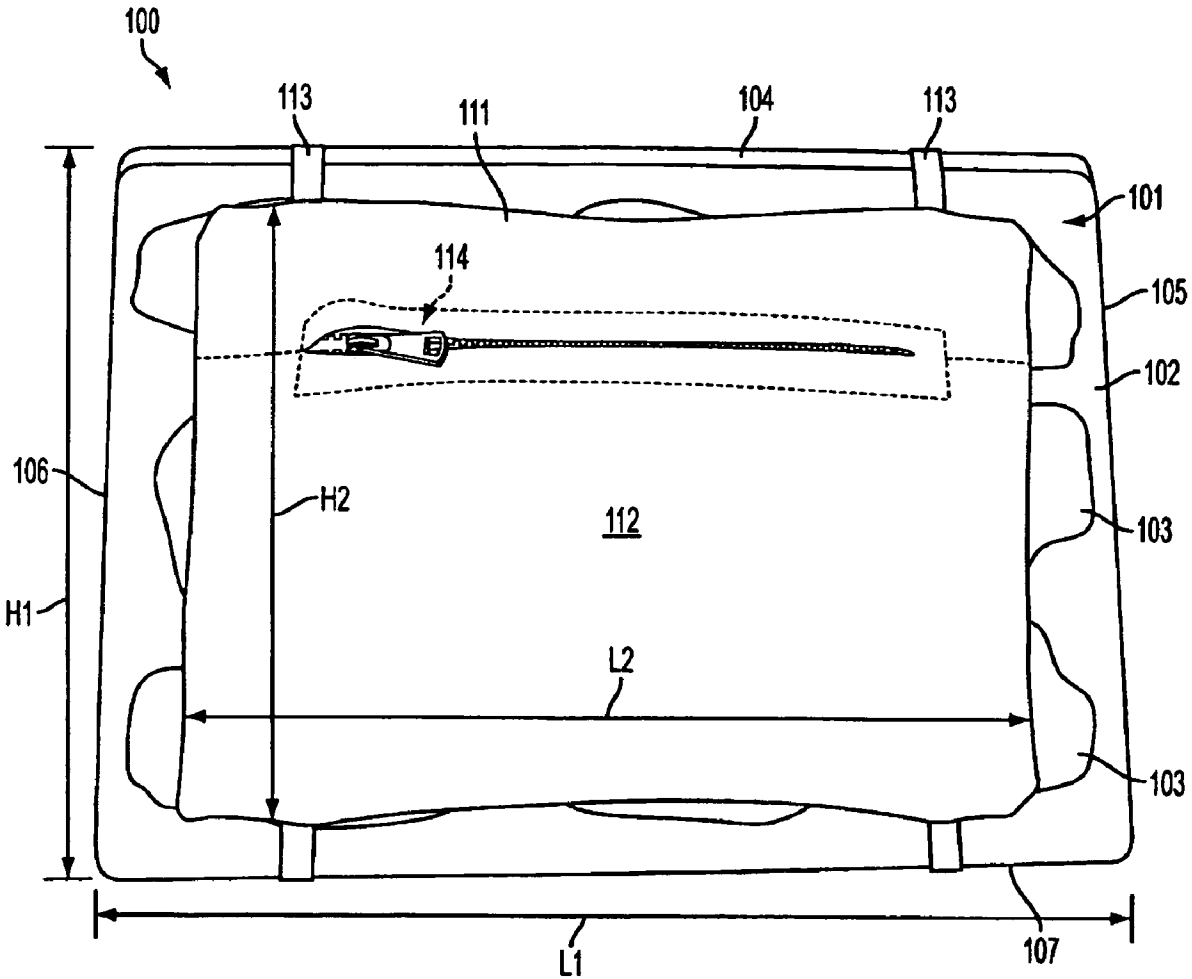
FIG. 1A depicts an exemplary puzzle storage and transportation system according to an embodiment of the disclosure.

FIGS. 1A and 1B depict an exemplary embodiment of a puzzle storage and transport system 100 according to an embodiment of the disclosure. Puzzle storage and transport system 100 may include a puzzle 101 and a container 110 to store pieces (not shown) of a puzzle. Puzzle 101 may include a puzzle board 102 and cut outs 103 to receive corresponding pieces (not shown). As noted above, puzzle 101 may be made of wood, metal, magnetic, plastic, or other like material.

Puzzle board 102 may have a top side 104, a right side 105, a left side 106, a bottom side 107, a front surface 108, and a back surface 109. Front surface 108 may contain cut outs 103 as illustrated in FIG. 1A.

Container 110 may have a pouch 111 defining a cavity 112, a closure 114 that may provide access to cavity 112 and straps 113 that may bind pouch 111 to puzzle board 102. In various exemplary embodiments, container 110 may enable storage and/or transportation of puzzle pieces (not shown) in cavity 112.

Pouch 111 may represent any bag or like structure of small or moderate size for storing or transporting goods (e.g., puzzle pieces, pens, pencils, magic markers, and/or any combination of like goods). Pouch 111 may be made of a pliable materials including without limitation cotton, a synthetic polymer such as nylon, ballistic nylon, Lycra® or Cordura® from Invista of Wichita, Kans., USA, plastic, heavy duty plastic, and/or any other like pliable material.

Pouch 111 may include a closure 114 that may provide access to cavity 112. In various exemplary embodiments, closure 114 may include any structure that may close cavity 112 and/or contain the goods within cavity 112 during storage and/or transportation of the goods. For example, as shown in FIGS. 1A and 1B, closure 114 may be a zipper. Closure 114 may also include Velcro, buttons, snaps, a flap, a slide fastener similar to the Ziploc Easy Zipper® from S.C. Johnson & Sons, Inc. of Racine, Wis., USA, and/or any like structure, and/or any combination thereof.

Figure 14:
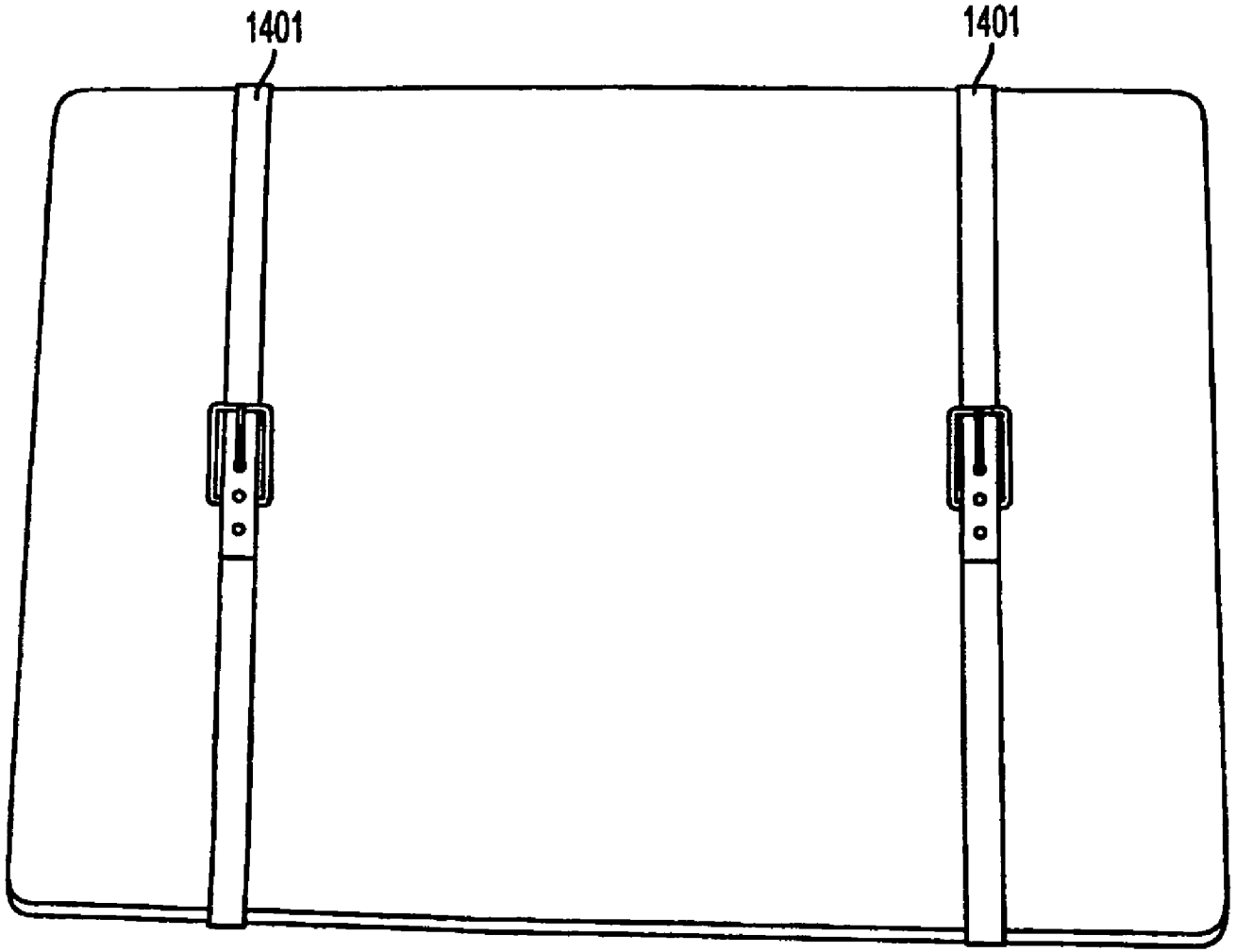
FIG. 14 depicts an exemplary puzzle storage and transportation system according to an embodiment of the disclosure.

As noted above, pouch 111 may include straps 113 that may bind container 110 to puzzle board 102. Straps 113 may be made of an elastomer or like elastic material that may enable container 110 to be positioned adjacent puzzle board 102 as shown, for example, in FIG. 1B. Straps 113 may also include an adjustable strap that may be similar to those found on back packs or luggage and/or may contain Velcro, buttons, or snaps to fasten one piece of the adjustable strap to the other. FIG. 14 illustrates an exemplary embodiment of a container having adjustable straps 1401.

In an exemplary embodiment, as noted above, puzzle 101 may be a children's puzzle and may include a puzzle board 102. In such an embodiment, puzzle board 102 may have a length L1 of approximately 14 inches and a height H1 of approximately 11 inches. Where puzzle board 102 has a length L1 of approximately 14 inches, pouch 111 may have a length L2 of approximately 13-11 inches. Similarly, where puzzle board 102 has a height H1 of 11 inches, pouch may have a height H2 of approximately 10-8 inches. Also, a puzzle board may have a length L1 of approximately 12 inches and a height H1 of approximately 9 inches. Where puzzle board 102 has a length L1 of approximately 12 inches, pouch 111 may have a length L2 of approximately 11-9 inches. Similarly, where puzzle board 102 has a height H1 of approximately 9 inches, pouch 111 may have a height H2 of approximately 8-6 inches. Although the dimensions of a puzzle and container have been described as rectangular, a puzzle and container may form other shapes such as a square, circle, oval, hexagon, triangle, etc. Where the puzzle board is a shape other than rectangular or square, the container may contain any number of straps that may enable to bind the container to the puzzle board.

Figure 2:
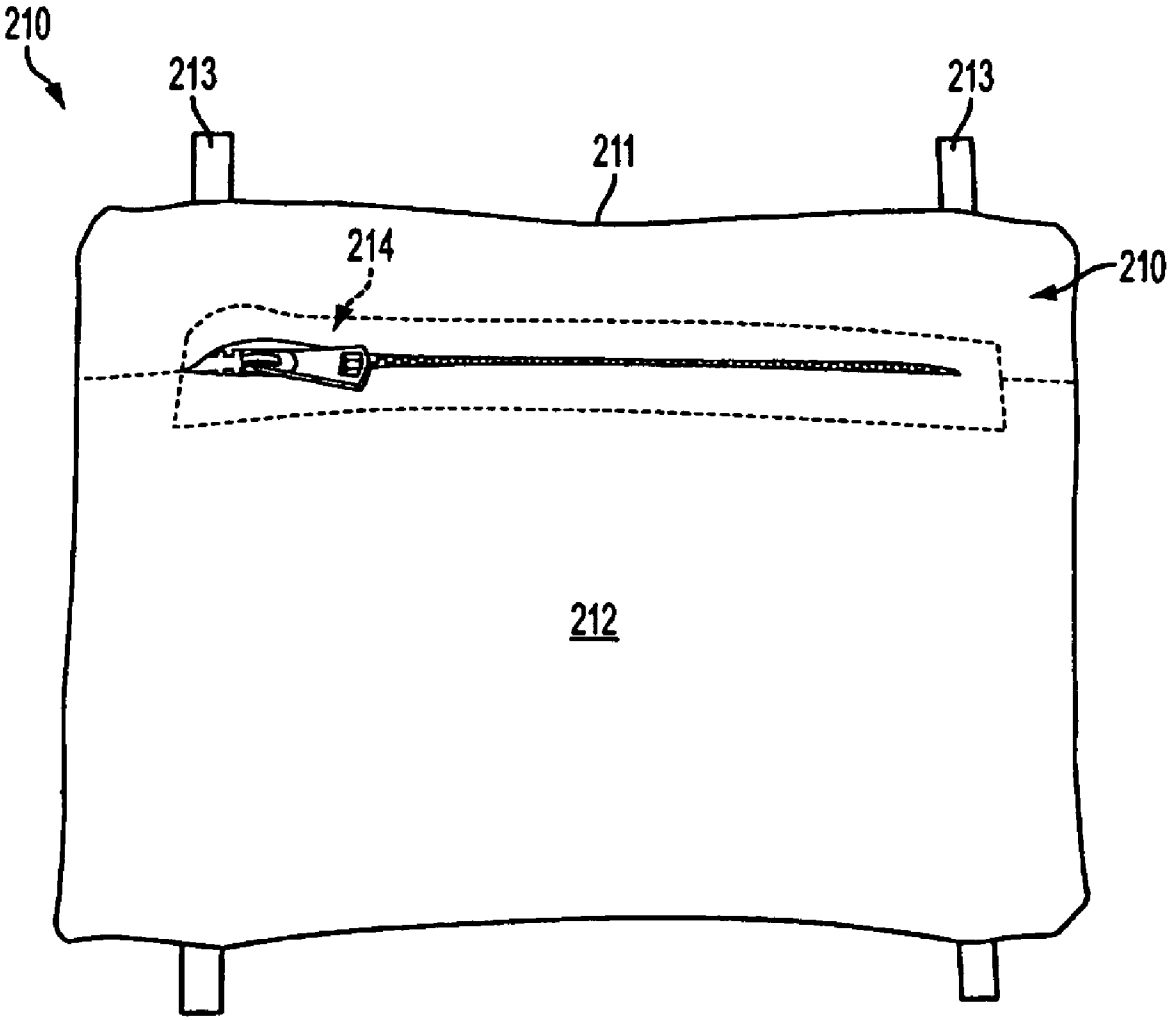
FIG. 2 depicts an exemplary puzzle storage and transportation system according to an embodiment of the disclosure.

FIG. 2 depicts an exemplary embodiment of a container 210 for storing and/or transporting puzzle pieces and/or other goods. Container 210 may be a similar container as container 110. Accordingly, container 210 may have a pouch 211 defining a cavity 212, a closure 214 that may provide access to cavity 212 and straps 213 that may bind pouch 211 to a puzzle board. In various exemplary embodiments, container 210 may enable storage and/or transportation of puzzle pieces (not shown) in cavity 212.

Figure 3B:
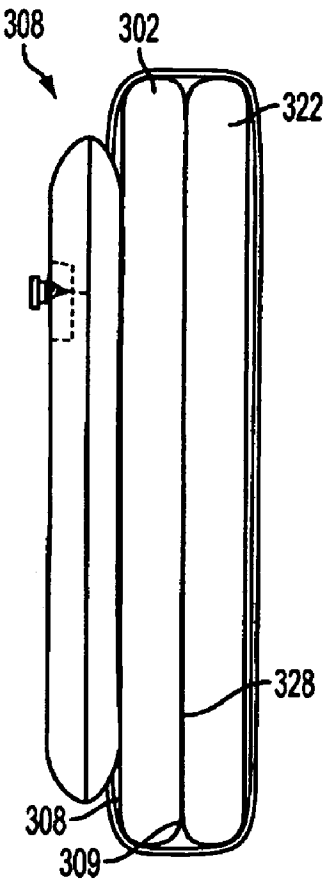
FIG. 3B depicts an exemplary puzzle storage and transportation system according to an embodiment of the disclosure.
Figure 3A:
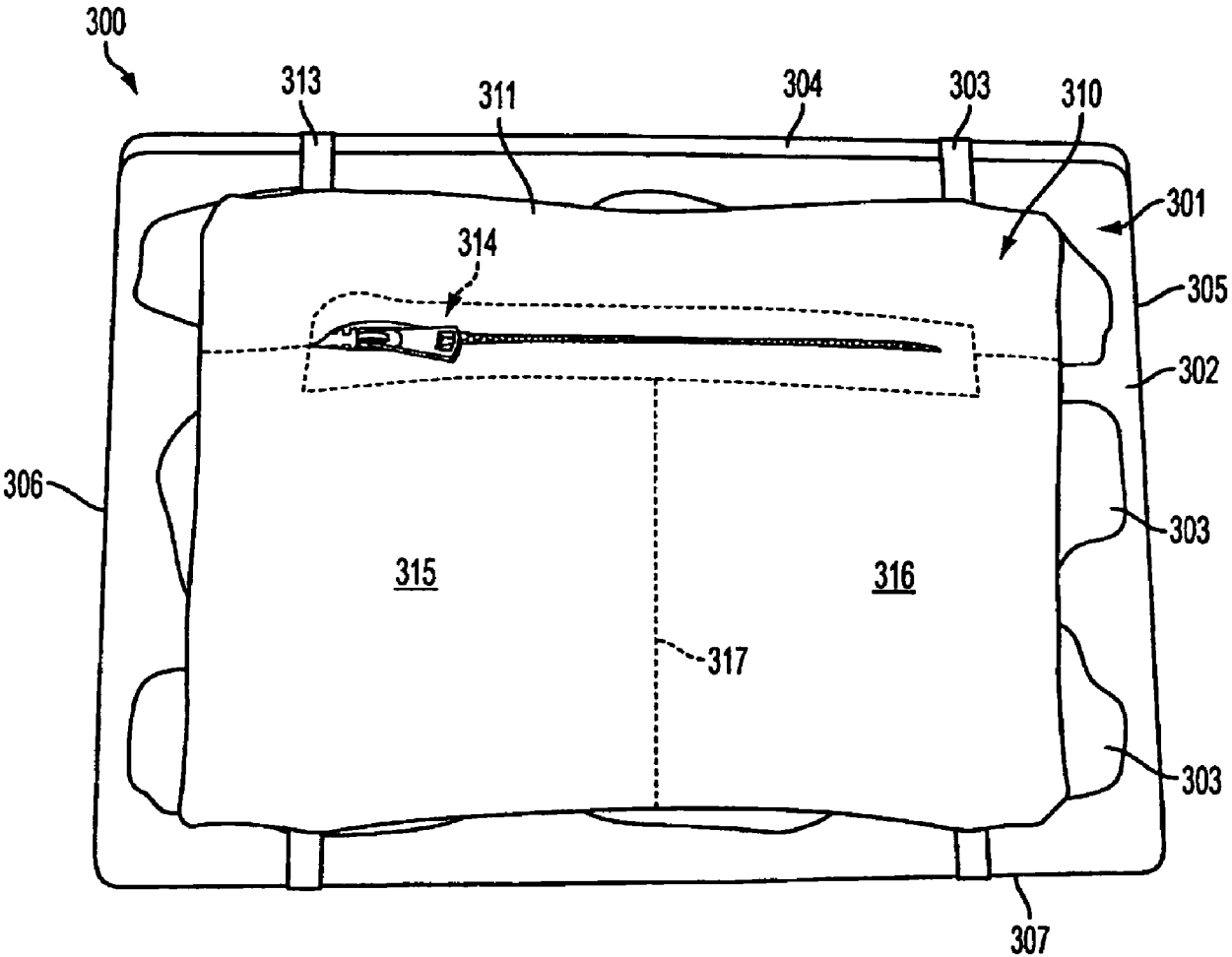
FIG. 3A depicts an exemplary puzzle storage and transportation system according to an embodiment of the disclosure.

FIGS. 3A and 3B depict an exemplary embodiment of a puzzle storage and transport system 300 according to an embodiment of the disclosure. Puzzle storage and transport system 300 may include a puzzle 301 and a container 310 to store pieces (not shown) of a puzzle. Puzzle 301 may include a puzzle board 302 and cutouts 303 to receive corresponding pieces (not shown).

Puzzle board 302 may have a top side 304, a right side 305, a left side 306, a bottom side 307, a front surface 308, and a back surface 309. Front surface 308 may contain cut outs 303 as illustrated in FIG. 3A.

Container 310 may have a pouch 311 defining a cavity 312, a closure 314 that may provide access to cavity 312 and straps 313 that may bind pouch 311 to puzzle board 302. In various exemplary embodiments, container 310 may enable storage and/or transportation of puzzle pieces (not shown) in cavity 312.

As shown in FIG. 3A, pouch 311 may include two compartments 315, 316 within cavity 312 that may be separated by a divider 317. Each compartment 315, 316 may store pieces (not shown) of a puzzle. Also, although not shown in FIG. 3A or 3B, straps 313 may bind container to one, two, or more puzzle boards (as shown in, for example, FIGS. 4B and 6B). In such an embodiment, pieces of a first puzzle may be stored and/or transported in one compartment 315 and pieces of a second puzzle may be stored and/or transported in the other compartment 316. Closure 314 may provide access to each compartment 315, 316 within cavity 312.

As shown in FIG. 3B and described above, straps 313 may bind container 310 to two puzzle boards 302 and 322 such that a back surface 309 of puzzle board 302 is adjacent to a front surface 328 of puzzle board 322.

Figure 4B:
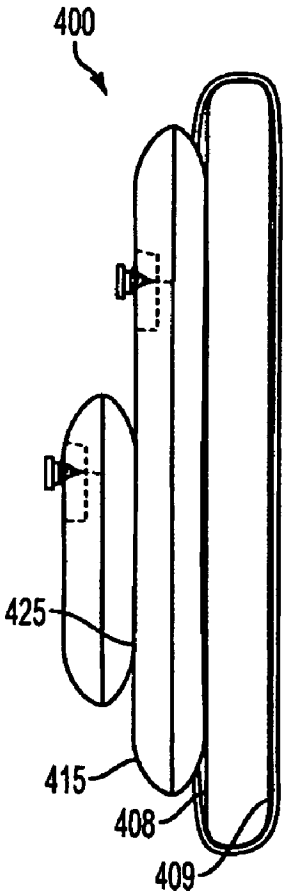
FIG. 4B depicts an exemplary puzzle storage and transportation system according to an embodiment of the disclosure.
Figure 4A:
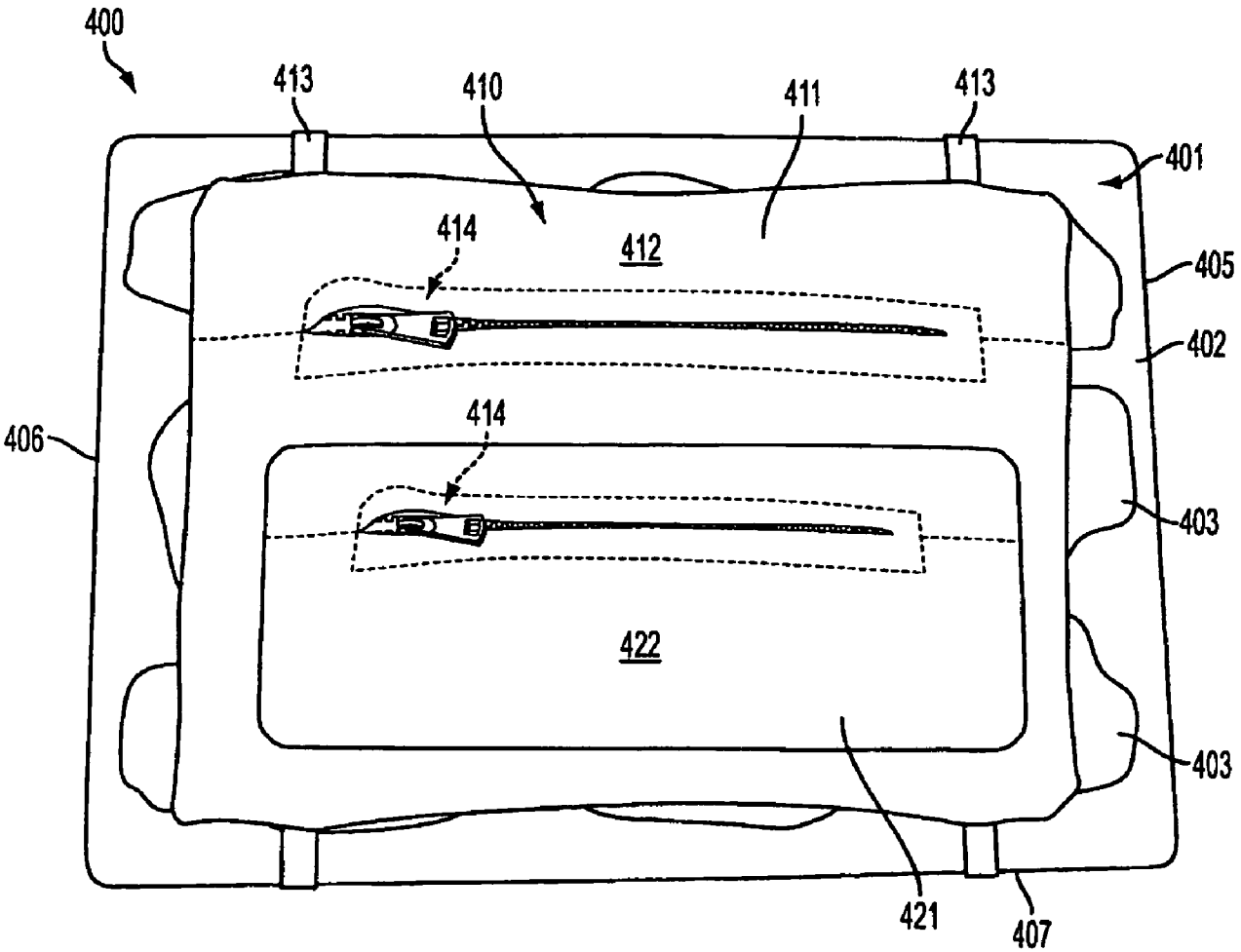
FIG. 4A depicts an exemplary puzzle storage and transportation system according to an embodiment of the disclosure.

FIGS. 4A and 4B depict an exemplary embodiment of a puzzle storage and transport system 400 according to an embodiment of the disclosure. Puzzle storage and transport system 400 may include a puzzle 401 and a container 410. Puzzle 401 may include a puzzle board 402 and cut outs 403 to receive corresponding pieces (not shown).

Puzzle board 402 may have a top side 404, a right side 405, a left side 406, a bottom side 407, a front surface 408 and a back surface 409. Front surface 408 may contain cut outs 403 as illustrated in FIG. 4A.

Container 410 may have a first pouch 411 defining a first cavity 412, a second pouch 421 defining a second cavity 422, and straps 413 that may bind first pouch 411 and second pouch 421 to puzzle board 402. First pouch 411 may include a closure 414 that may provide access to cavity 412 and second pouch 421 may also include a closure 424 that may provide access to cavity 422. As shown in FIGS. 4A and 4B, second pouch 421 may be coupled to first pouch 411 such that a back surface 425 of second pouch 421 is adjacent to a front surface 415 of first pouch 411. Also, second pouch 421 may be coupled to first pouch 411 such that second pouch 421 is adjacent to a front surface 415 of first pouch 411 and beneath closure 414 of first pouch 411. In an exemplary embodiment, second pouch 421 may store and/or transport any type of goods including, without limitation, crayons, pens, pencils, markers, puzzle pieces, and/or any like items. Where, for example, second pouch 411 stores crayons, pencils, pens, markers and/or like items, a coloring book or similar item may be bound by straps 413.

Figure 5B:
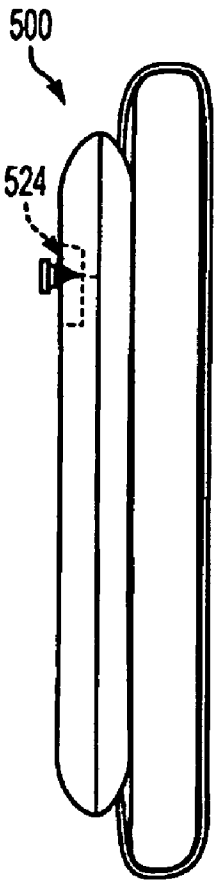
FIG. 5B depicts an exemplary puzzle storage and transportation system according to an embodiment of the disclosure.
Figure 5A:
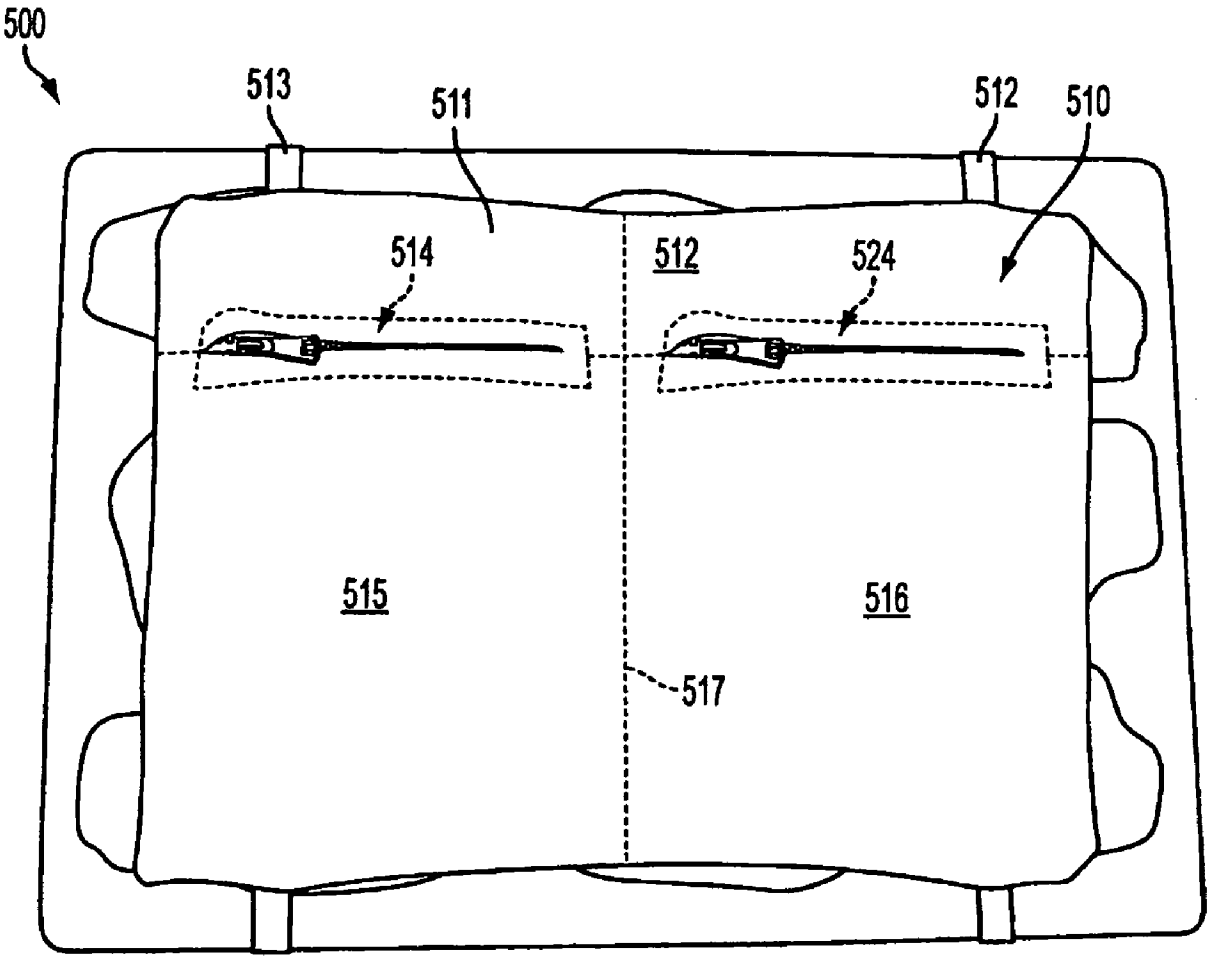
FIG. 5A depicts an exemplary puzzle storage and transportation system according to an embodiment of the disclosure.

FIGS. 5A and 5B depict an exemplary embodiment of a puzzle storage and transport system 500 according to an embodiment of the disclosure. As shown in FIG. 5A, a container 510 may have a pouch 511 defining a cavity 512. Pouch 511 may include two compartments 515, 516 within cavity 512 that may be separated by a divider 517. Each compartment 515, 516 may store pieces (not shown) of a puzzle. Also, although not shown in FIG. 5A or 5B, straps 513 may bind container to one, two, or more puzzle boards (as shown in, for example, FIGS. 4B and 6B). In such an embodiment, pieces of a first puzzle may be stored and/or transported in one compartment 515 and pieces of a second puzzle may be stored and/or transported in the other compartment 516.

As shown in FIG. 5A, a first closure 514 may provide access to a first compartment 515 and a second closure 524 may provide access to a second compartment 516. Each compartment 515, 516 may be separated by a divider 517. Each compartment 515, 516 may store pieces (not shown) of a puzzle. Also, although not shown in FIG. 5A or 5B, straps 513 may bind container to one, two, or more puzzle boards (as shown in, for example, FIGS. 4B and 6B). In such an embodiment, pieces of a first puzzle may be stored and/or transported in one compartment 515 and pieces of a second puzzle may be stored and/or transported in the other compartment 516.

Figure 6B:
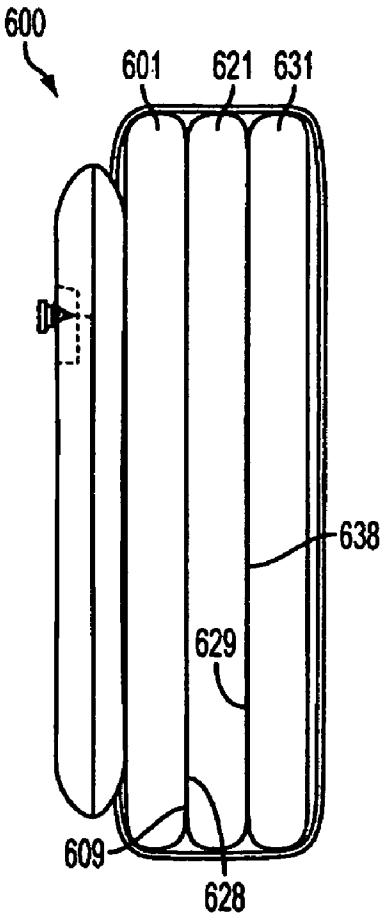
FIG. 6B depicts an exemplary puzzle storage and transportation system according to an embodiment of the disclosure.
Figure 6A:
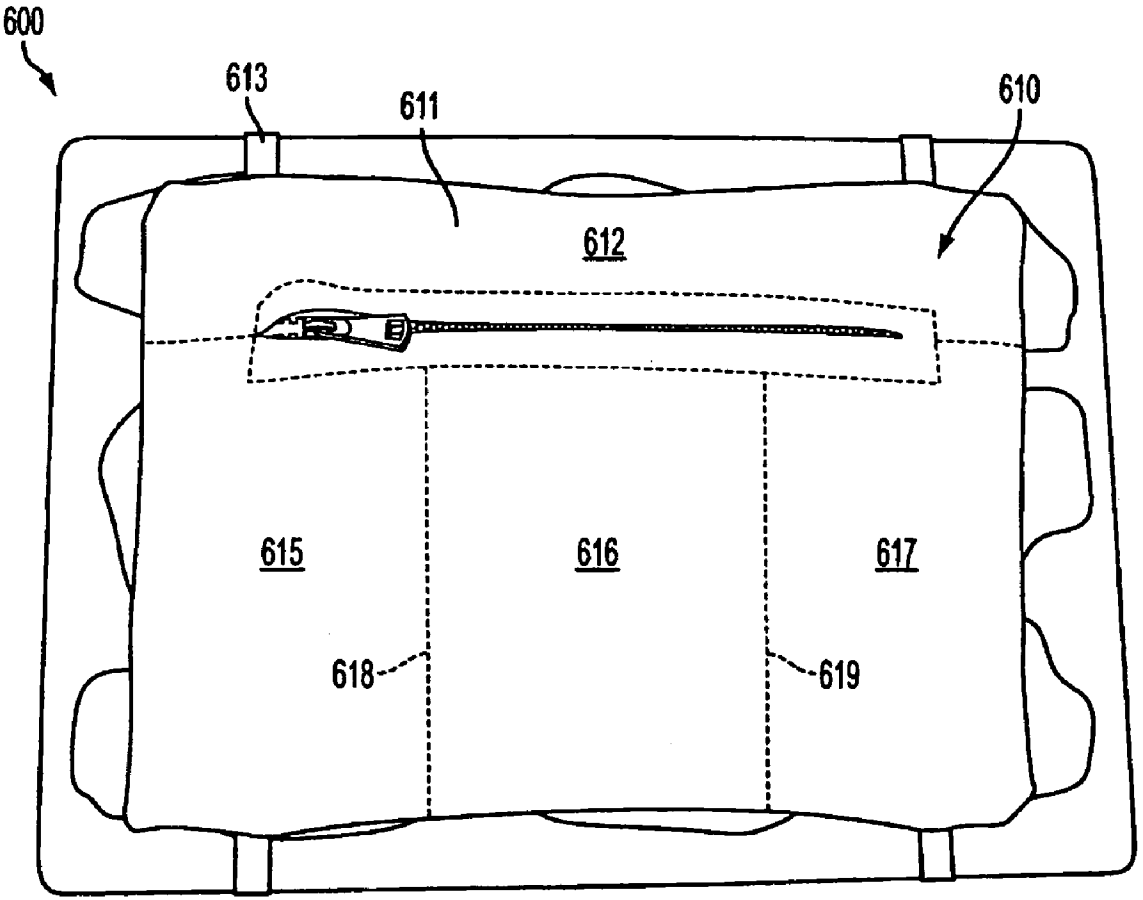
FIG. 6A depicts an exemplary puzzle storage and transportation system according to an embodiment of the disclosure.

FIGS. 6A and 6B depict an exemplary embodiment of a puzzle storage and transport system 600 according to an embodiment of the disclosure. As shown in FIG. 6A, a container 610 may have a pouch 611 defining a cavity 512. Pouch 611 may include three compartments 615, 616, 617 within cavity 612 that may be separated by dividers 618, 619. Each compartment 615, 616, 617 may store pieces (not shown) of a puzzle. As shown in FIG. 6B, straps 613 may bind container three puzzle boards 601, 621, 631 such that a back surface 609 of puzzle board may be adjacent to a front surface 628 of puzzle board 621 and a back surface 629 of puzzle board 621 may be adjacent to a front surface 638 of puzzle board 631. In such an embodiment, pieces of a first puzzle may be stored and/or transported in one compartment 615, pieces of a second puzzle may be stored and/or transported in the other compartment 616 and pieces of a third puzzle may be stored and/or transported in the other compartment 617.

As shown in FIG. 6A, a closure 614 may provide access to the compartments 615, 616, 617.

Figure 7A:
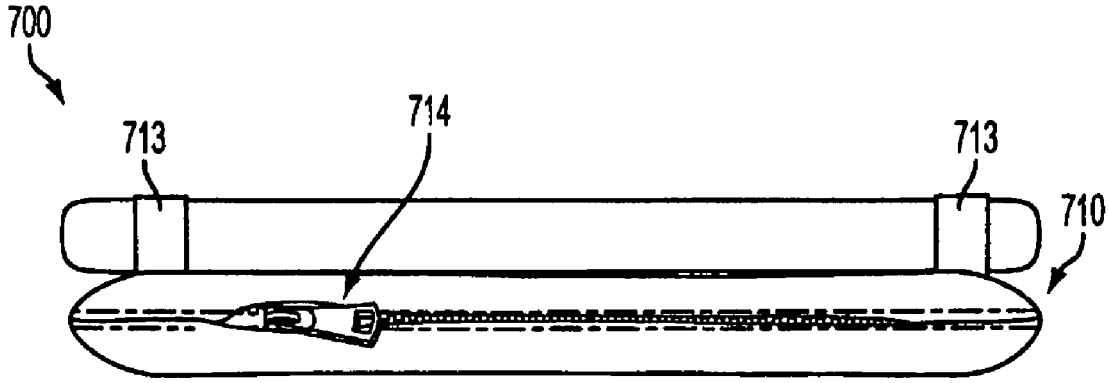
FIG. 7A depicts an exemplary puzzle storage and transportation system according to an embodiment of the disclosure.
Figure 7B:
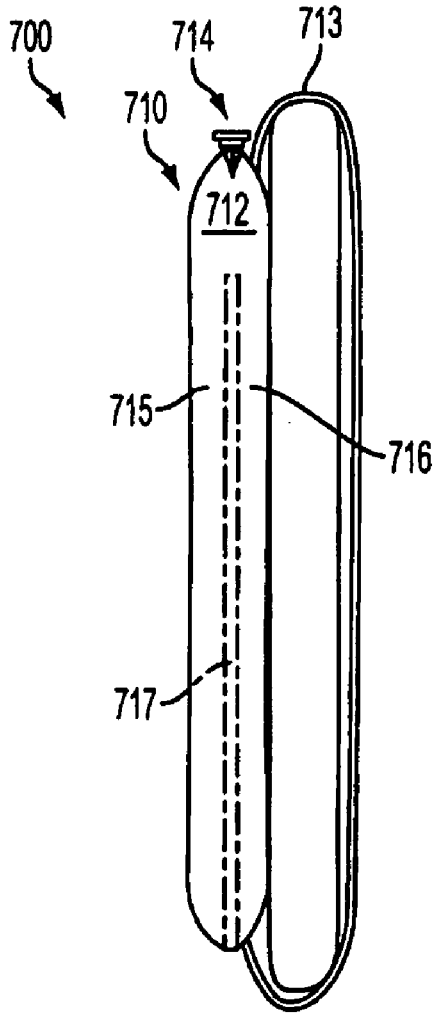
FIG. 7B depicts an exemplary puzzle storage and transportation system according to an embodiment of the disclosure.

FIGS. 7A and 7B depict an exemplary embodiment of a puzzle storage and transport system 700 according to an embodiment of the disclosure. As shown in FIG. 7B, a container 710 may have a pouch 711 defining a cavity 712. Pouch 711 may include two compartments 715, 716 within cavity 712 that may be separated by a divider 717. Each compartment 715, 716 may store pieces (not shown) of a puzzle. Also, although not shown in FIG. 7A or 7B, straps 713 may bind container to one, two, or more puzzle boards (as shown in, for example, FIGS. 4B and 6B). In such an embodiment, pieces of a first puzzle may be stored and/or transported in one compartment 715 and pieces of a second puzzle may be stored and/or transported in the other compartment 716.

A closure 714 may provide access to cavity 712. As shown in FIGS. 7A and 7B, closure 714 may be located on a top portion of container 710. Also, although not shown in FIG. 7A or 7B, straps 713 may bind container to one, two, or more puzzle boards (as shown in, for example, FIGS. 4B and 6B). In such an embodiment, pieces of a first puzzle may be stored and/or transported in one compartment 715 and pieces of a second puzzle may be stored and/or transported in the other compartment 716.

Figure 8A:
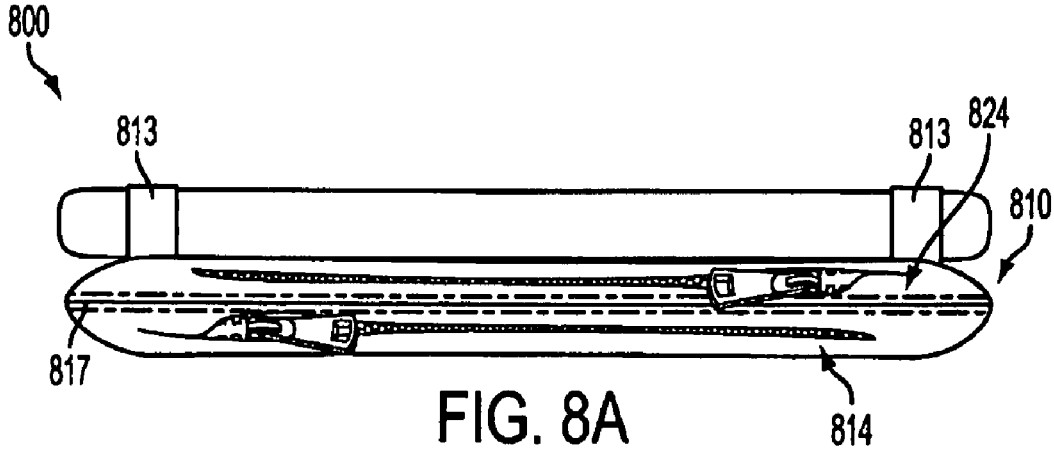
FIG. 8A depicts an exemplary puzzle storage and transportation system according to an embodiment of the disclosure.
Figure 8B:
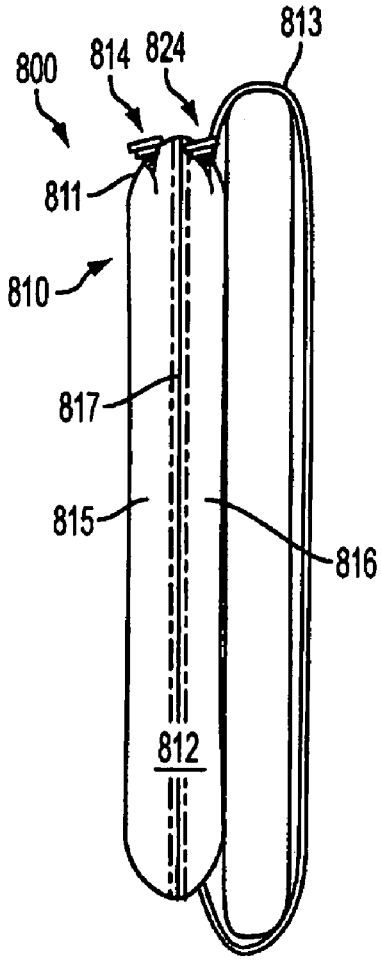
FIG. 8B depicts an exemplary puzzle storage and transportation system according to an embodiment of the disclosure.

FIGS. 8A and 8B depict an exemplary embodiment of a puzzle storage and transport system 800 according to an embodiment of the disclosure. As shown in FIG. 8B, a container 810 may have a pouch 811 defining a cavity 812. Pouch 811 may include two compartments 815, 816 within cavity 812 that may be separated by a divider 817. Each compartment 815, 586 may store pieces (not shown) of a puzzle. Also, although not shown in FIG. 8A or 8B, straps 813 may bind container to one, two, or more puzzle boards (as shown in, for example, FIGS. 4B and 6B). In such an embodiment, pieces of a first puzzle may be stored and/or transported in one compartment 815 and pieces of a second puzzle may be stored and/or transported in the other compartment 816.

As shown in FIGS. 8A and 8B, a first closure 814 may provide access to a first compartment 815 and a second closure 824 may provide access to a second compartment 816 from the top of container 810. Each compartment 815, 816 may be separated by a divider 817. Each compartment 815, 816 may store pieces (not shown) of a puzzle. Also, although not shown in FIG. 8A or 8B, straps 813 may bind container to one, two, or more puzzle boards (as shown in, for example, FIGS. 4B and 6B). In such an embodiment, pieces of a first puzzle may be stored and/or transported in one compartment 815 and pieces of a second puzzle may be stored and/or transported in the other compartment 816.

Figure 9:
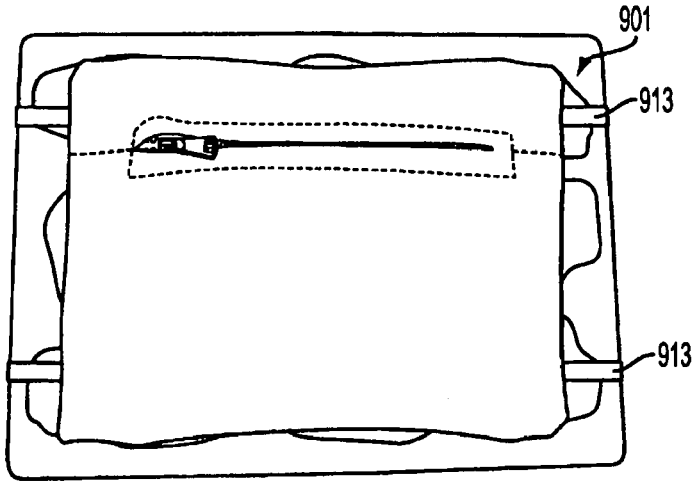
FIG. 9 depicts an exemplary puzzle storage and transportation system according to an embodiment of the disclosure.
Figure 10:
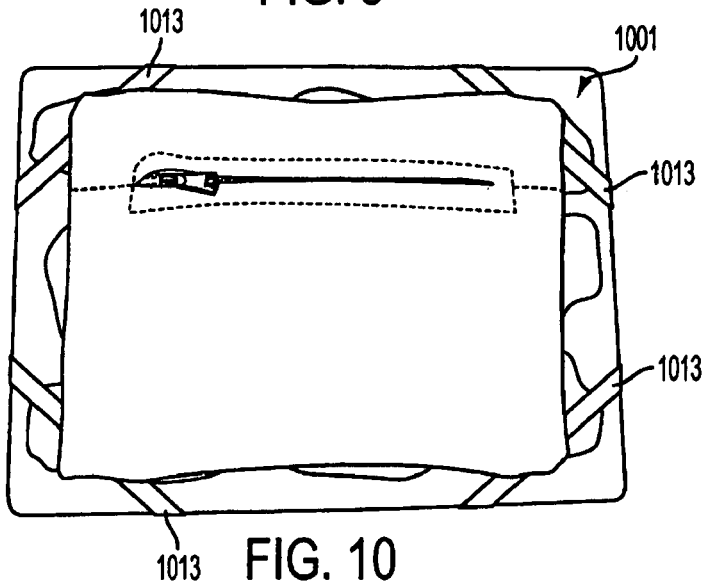
FIG. 10 depicts an exemplary puzzle storage and transportation system according to an embodiment of the disclosure.
Figure 11:
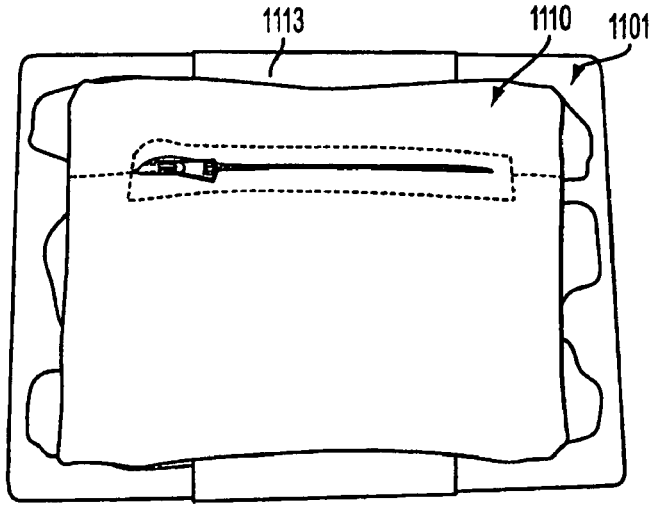
FIG. 11 depicts an exemplary puzzle storage and transportation system according to an embodiment of the disclosure.

The exemplary embodiments illustrated above all include straps that may bind a container to a puzzle board. While straps shown and described are horizontal relative to the puzzle board, other straps may be considered. For example, as shown in FIG. 9, straps 913 may be vertical relative to puzzle board 901. As shown in FIG. 10, straps 1013 may wrap around the corners of puzzle board 1001. And as shown in FIG. 11, a single wide strap 1113 may bind container 1110 to puzzle board 1101.

Figure 12:
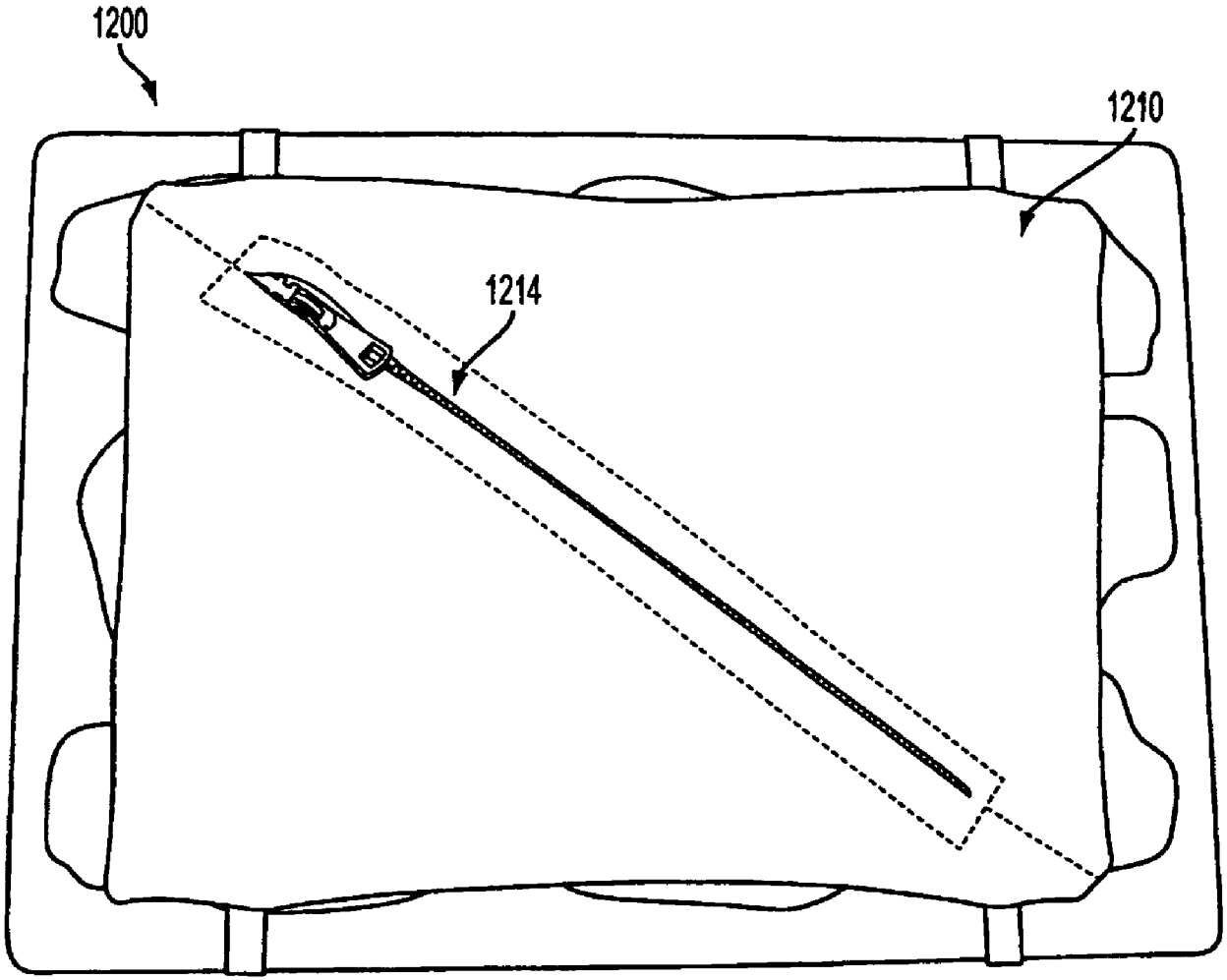
FIG. 12 depicts an exemplary puzzle storage and transportation system according to an embodiment of the disclosure.

FIG. 12 depicts an exemplary embodiment of a puzzle storage and transport system 1200 according to an embodiment of the disclosure. As shown in FIG. 12, container 1210 may include a closure 1214 that may be placed diagonally on container 1210.

Figure 13:
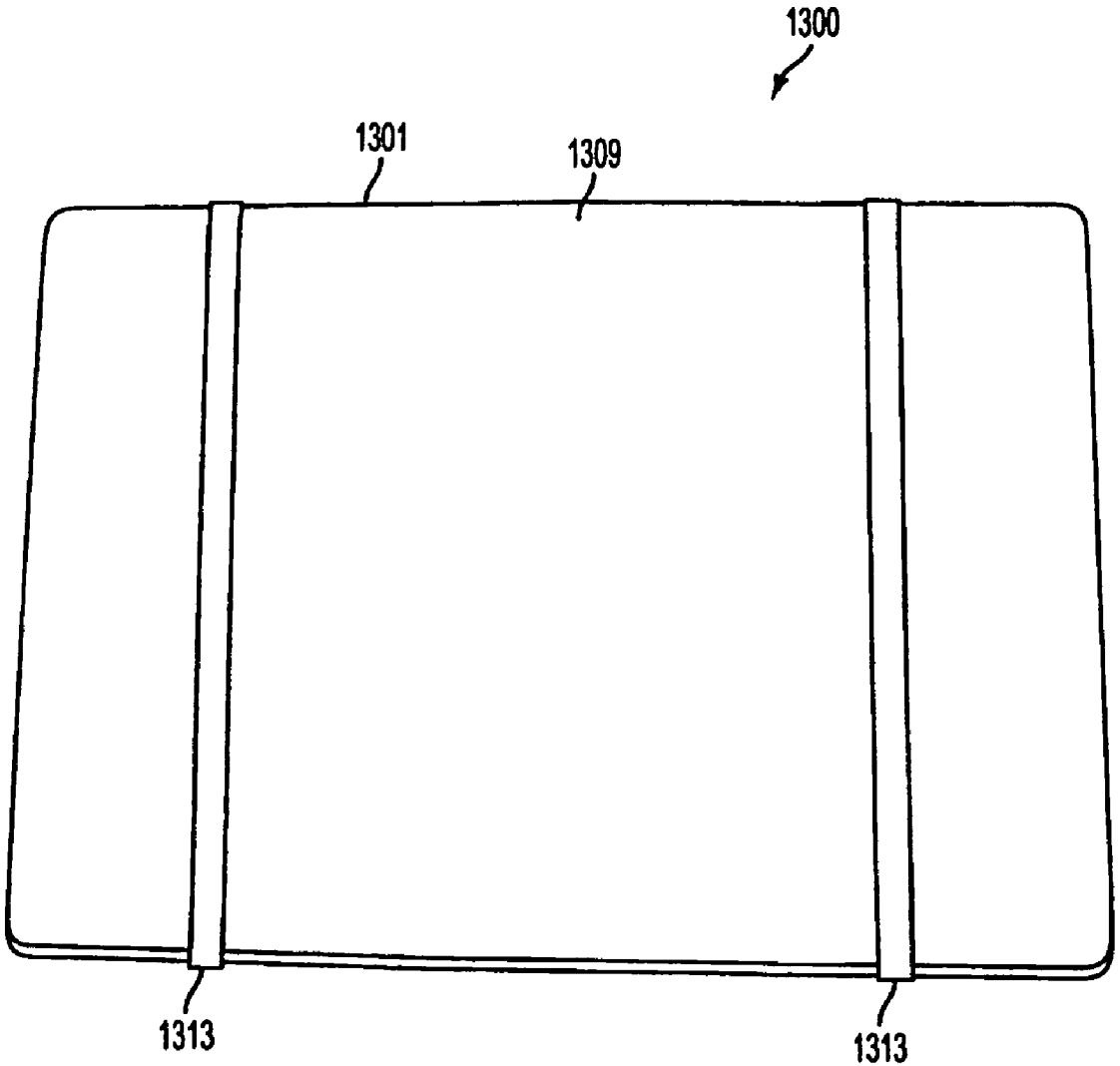
FIG. 13 depicts an exemplary puzzle storage and transportation system according to an embodiment of the disclosure.

FIG. 13 depicts an exemplary embodiment of a puzzle storage and transport system 1300 according to an embodiment of the disclosure. As shown in FIG. 13, straps 1313 may wrap around a back surface 1309 of a puzzle board 1301.

Figure 15B:
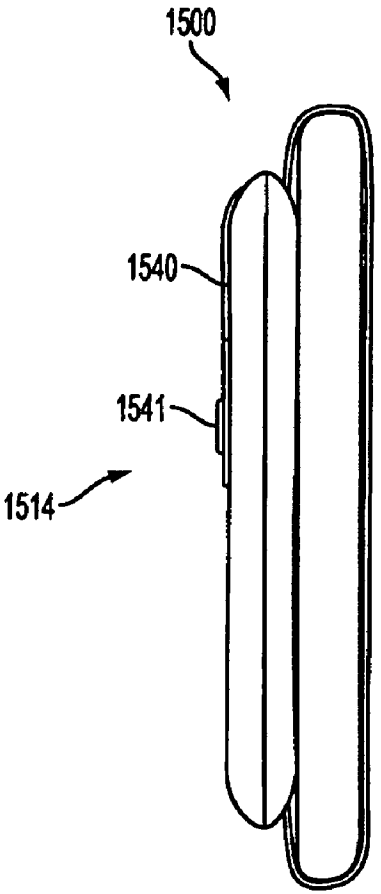
FIG. 15B depicts an exemplary puzzle storage and transportation system according to an embodiment of the disclosure.
Figure 15A:
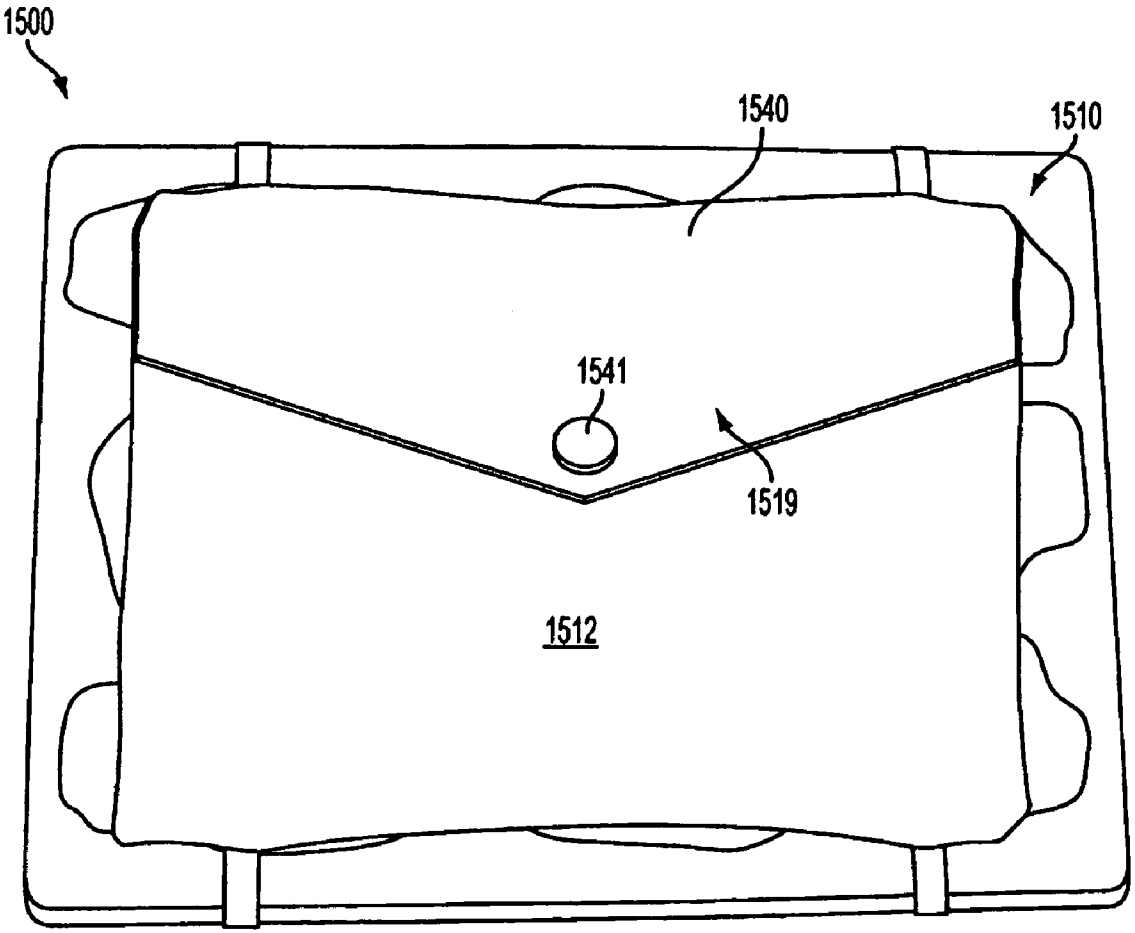
FIG. 15A depicts an exemplary puzzle storage and transportation system according to an embodiment of the disclosure.

FIGS. 15A and 15B depict an exemplary embodiment of a puzzle storage and transport system 1500 according to an embodiment of the disclosure. As shown in FIG. 15, a container 1510 may include a closure 1514 that includes a flap 1540 and a snap 1541 for providing access to cavity 1512.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A puzzle storage and transport system, comprising:

a puzzle including one or more puzzle pieces and a puzzle board; and a container to store and transport one or more puzzle pieces, the container including:

a pouch defining a cavity to contain the one or more puzzle pieces and including a closure to provide access to the cavity, and one or more straps coupled to the pouch to bind an outside surface of the container to the puzzle board.

2. The puzzle and storage and transport system according to claim 1, wherein the puzzle board includes one or more cut outs to receive the one or more respective puzzle pieces.

3. The puzzle and storage and transport system according to claim 1, wherein the puzzle board comprises one of wood, metal, and plastic.

4. The puzzle and storage and transport system according to claim 1, wherein the pouch comprises a pliable material.

5. The puzzle and storage and transport system according to claim 4, wherein the pliable material comprises at least one of cotton, synthetic polymer, and plastic.

6. The puzzle and storage and transport system according to claim 1, wherein the closure comprises a zipper, velcro, a fastener, or a slide fastener.

7. The puzzle and storage and transport system according to claim 1, further comprising:

a second pouch coupled to the pouch, the second pouch defining a second cavity and including a second closure to provide access to the second cavity.

8. The puzzle and storage and transport system according to claim 1, the pouch further comprising:

a divider to define first and second compartments within the cavity.

9. The puzzle and storage and transport system according to claim 8, wherein the closure provides access to the first compartment and wherein the pouch includes a second closure to provide access to the second compartment.

10. A method for storing and transporting one or more puzzle pieces, comprising:

containing the one or more puzzle pieces within a container, the container including a pouch defining a cavity to contain the one or more puzzle pieces and including a closure to provide access to the cavity, and one or more straps coupled to the pouch to bind an outside surface of the container to a puzzle board; and binding an outside surface of the container to the puzzle board.

* * * * *